United States Patent [19]

Seilly et al.

[11] Patent Number: 4,523,569

[45] Date of Patent: Jun. 18, 1985

[54] LIQUID FUEL PUMPING APPARATUS

[75] Inventors: Alec H. Seilly, North Wembley; Andrew E. Murray, London, both of England

[73] Assignee: Lucas Industries public limited company, Birmingham, England

[21] Appl. No.: 540,558

[22] Filed: Oct. 11, 1983

[30] Foreign Application Priority Data

Oct. 21, 1982 [GB] United Kingdom ..... 8230045

[51] Int. Cl.[3] ..... F02M 39/00

[52] U.S. Cl. ..... 123/458; 123/506; 123/494; 123/450; 417/462

[58] Field of Search ..... 123/458, 459, 506, 357, 123/358, 359, 494, 450; 417/462

[56] References Cited

U.S. PATENT DOCUMENTS 4,351,283 9/1982 Ament ..... 123/506
4,382,751 5/1983 Potter ..... 123/459
4,395,987 8/1983 Kobayashi et al. ..... 123/459
4,421,088 12/1983 Seilly ..... 123/458
4,426,978 1/1984 Sasaki et al. ..... 123/459

FOREIGN PATENT DOCUMENTS 2086080 5/1982 United Kingdom ..... 123/494

*Primary Examiner*—Magdalen Y. C. Moy

[57] ABSTRACT

A liquid fuel pumping apparatus of the rotary distributor type has an electromagnetically operable spill control valve including a valve member which is closed to prevent spillage of fuel from the high pressure pump of the apparatus. A transducer including a core member and a winding is provided to provide signals from which it is possible to determine the instants of spill valve closure and opening. The signals are used in a control system to control the operation of the apparatus.

4 Claims, 4 Drawing Figures

LIQUID FUEL PUMPING APPARATUS

This invention relates to liquid fuel pumping apparatus for supplying fuel to an internal combustion engine, the apparatus comprising a plunger reciprocable within a bore, an outlet from said bore and through which fuel can flow during inward movement of the plunger and an electromagnetically operable spill valve which controls fuel flow through a passage connected to said bore, and which during inward movement of the plunger can be closed to cause fuel flow through the outlet.

With such an apparatus the period during which the valve is closed considered in terms of plunger movement, determines the quantity of fuel which is displaced through the outlet. The valve is required to operate very quickly in use, and it has been the practice to control the supply of current to the valve on a time basis considered in terms of plunger movement. There are, however, a number of disadvantages with this method of control and these mainly derive from the construction of the valve. Since the actuator of the valve is of an electromagnetic nature and incorporates a winding and an iron circuit, the valve takes a finite length of time to close owing to the gradual build-up of the magnetic flux in the iron circuit. It also requires a finite length of time to open, this usually being effected by the action of a spring. It will thus be appreciated that valves must be constructed to very narrow tolerances in order that the valves of a batch of valves can be said to be identical. In addition, variations in the spring force will result in variation in the closing and opening characteristics of the valve when in use. Apart from the construction of the actuator, the tolerances in the construction of the valves will cause differing operating times, for example, the total movement of the valve. External factors will also influence the operation of the valves for example, supply voltage variations and possible differences in the characteristics and response of the associated electrical control circuit.

The object of the invention is to provide an apparatus of the kind specified in a simple and convenient form.

According to the invention, an apparatus of the kind specified comprises means responsive to the movement of the valve for providing signals indicative of the state of the valve, said signals in use being supplied to a control circuit for the actuator of the valve.

An example of the apparatus in accordance with the invention will now be described with reference to the accompanying drawings, in which.

Figure 1:
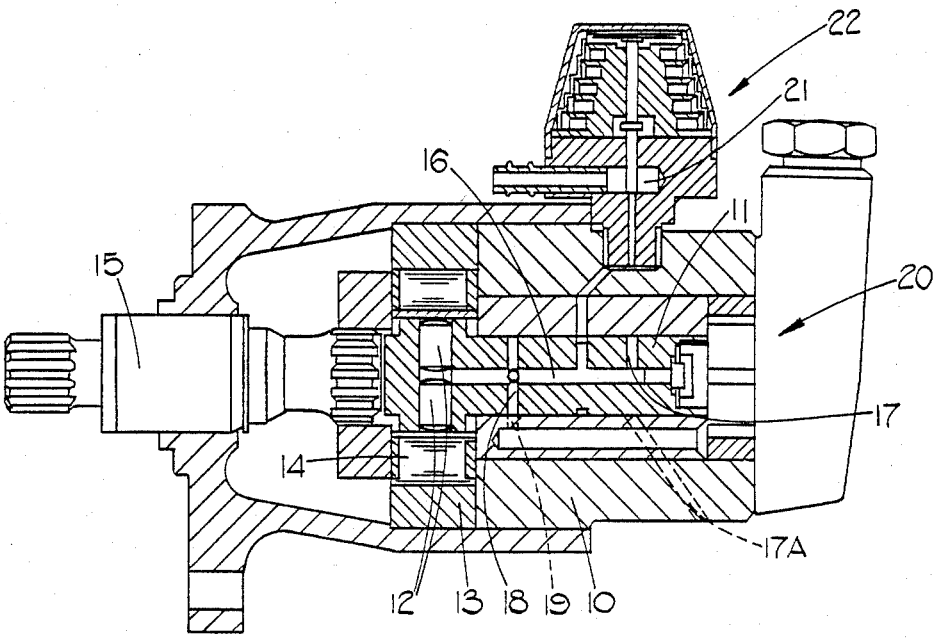
FIG. 1 is a sectional side elevation of a pumping apparatus incorporating an electromagnetically operable valve.

Referring to FIG. 1 of the drawings, there is illustrated a rotary distributor type of fuel pumping apparatus which includes a body 10 in which is located a rotary cylindrical distributor member 11. The distributor member is provided with a transverse bore in which is mounted a pair of pumping plungers 12 which are moved inwardly by the action of cam lobes on a surrounding annular cam 13 during rotation of the distributor member. The cam lobes transmit the movement to the plungers by way of cam followers which incorporate rollers 14. The distributor member is connected to a rotary drive shaft 15 which in use, is connected to a rotary part of the engine so as to be driven in timed relationship therewith.

The bore containing the plungers communicates with a central passage 16 in the distributor member and this communicates with a radially extending delivery passage 17 which can register in turn with equiangularly spaced outlet ports one of which is shown at 17A, during the inward movement of the pumping plungers. The outlet ports are connected in use to injection nozzles respectively of an associated engine.

At another point the central passage 16 communicates with a plurality of inlet passages 18 which can register in turn with an inlet port 19 connected to the outlet of a low pressure supply pump generally indicated at 20. The communication of one of the inlet passages 18 with the inlet port 19 occurs during the time that the plungers are allowed to move outwardly by the cam lobes and during such communication the bore containing the plungers is completely filled with fuel.

In the particular example, the central passage 16 communicates with a circumferential groove formed on the periphery of the distributor member and this groove is in constant communication by way of a spill passage, with a spill valve which is generally indicated at 21. The spill valve is shown in greater detail in FIG. 4, and it is controlled by an electromagnetic actuator generally indicated at 22. Instead of the continuous communication as described the communication of the central passage with the valve can be by way of ports.

In use, the quantity of fuel which is delivered by the apparatus to an injection nozzle of the engine is determined by the time considered in terms of degrees of rotation of the distributor member during which the spill valve 21 is closed. If, therefore, the valve is closed throughout the full inward movement of the plungers, the maximum amount of fuel which can be supplied by the apparatus will be supplied to the injection nozzle. In practice the amount of fuel supplied during normal operation of the engine will be very much less than the maximum amount and hence the valve will be closed for a shorter period. The timing of the start of delivery of fuel to the associated engine can be varied by adjusting the point in a working cycle of the pump, when the valve is closed.

Figure 4:
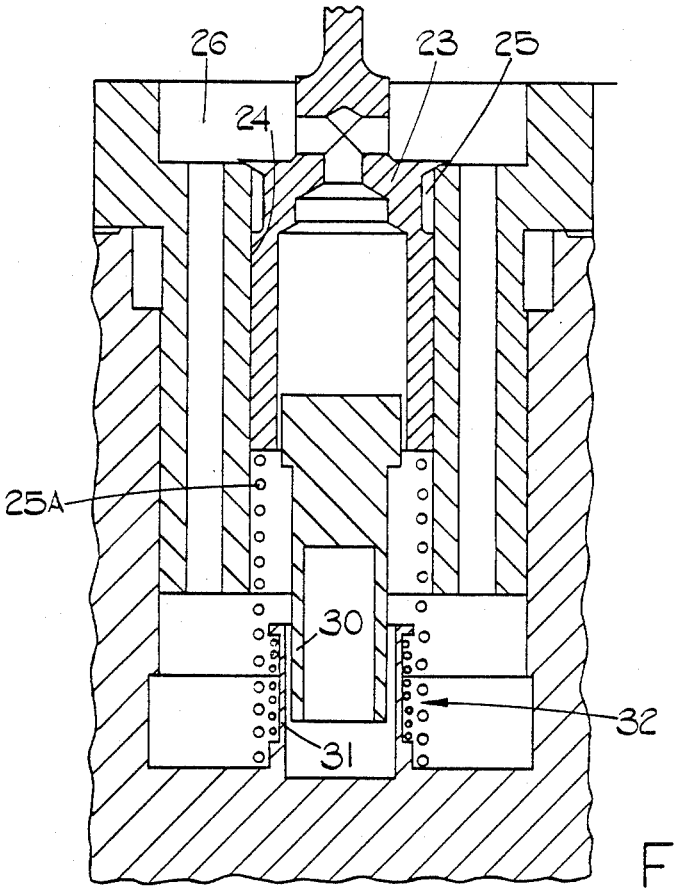
FIG. 4 shows the valve modified in accordance with the invention.

As shown in FIG. 4, the spill valve includes a valve member 23 which is slidable within a bore 24. The valve member has a head portion which is slightly larger than the diameter of the bore, and which co-operates with a seating at the end of the bore. Beneath the head portion the valve member is provided with a circumferential groove 25 which, by means of passages (not shown), communicates in the particular example, with the circumferential groove formed on the periphery of the distributor member 11.

The valve member is biased to an open position by means of a spring 25A and is movable to the closed position in which it is shown, upon energisation of the electromagnetic actuator. When the valve member is in the open position the groove 25 is exposed to a spill chamber 26 which communicates with a drain.

Figure 3:
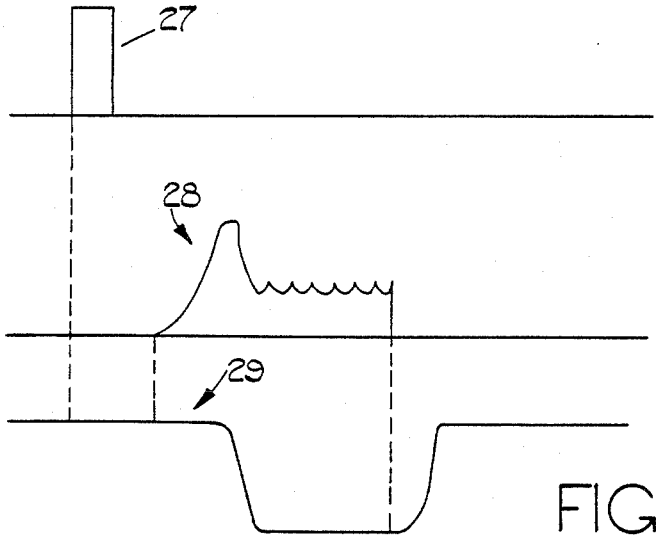
FIG. 3 illustrates the working characteristics of the valve.

The control of the electromagnetic actuator is effected by means of a control system to be described but, as previously explained, the movement of the valve member depends upon a number of factors. With reference to FIG. 3 there is indicated at 27, a pulse which derives from a transducer associated with a rotary part of the engine. This pulse is fed to the control system and a predetermined time after the beginning of the pulse, electric current as indicated at 28, is supplied to the actuator. Because the actuator has a winding and also an iron core, the current rises slowly in the actuator winding and only when the current has attained a predetermined value does the valve close. The movement of the valve member is indicated at 29. The current pulse is reduced to a holding value in order to economise on electrical power and also to reduce the amount of heat generated in the winding of the actuator. The valve however will be seen to remain in the closed position. It will be observed that a finite time is required for the valve to achieve the closed position and when the flow of electric current ceases, a further finite time is required for the valve member to move to the fully open position. As explained, manufacturing tolerances can influence greatly the time required for the valve member to move to the closed position following the commencement of current flow and in order to take into account this delay which may vary during the use of the apparatus, the spill valve is provided with a transducer which feeds a signal to the control circuit. The transducer is shown in FIG. 4 and includes a core member 30 movable within a hollow former 31 which carries a winding 32. From the signal produced by the transducer it is possible to tell the exact instant of valve closure and also valve opening. In practice fuel delivery will start to take place just before the valve is fully closed and will continue for a short time after the valve has started to open. This is because the valve will start to restrict the flow of fuel in the spill passage as it closes and this will result in pressurisation of the fuel in the delivery passage 17.

Figure 2:
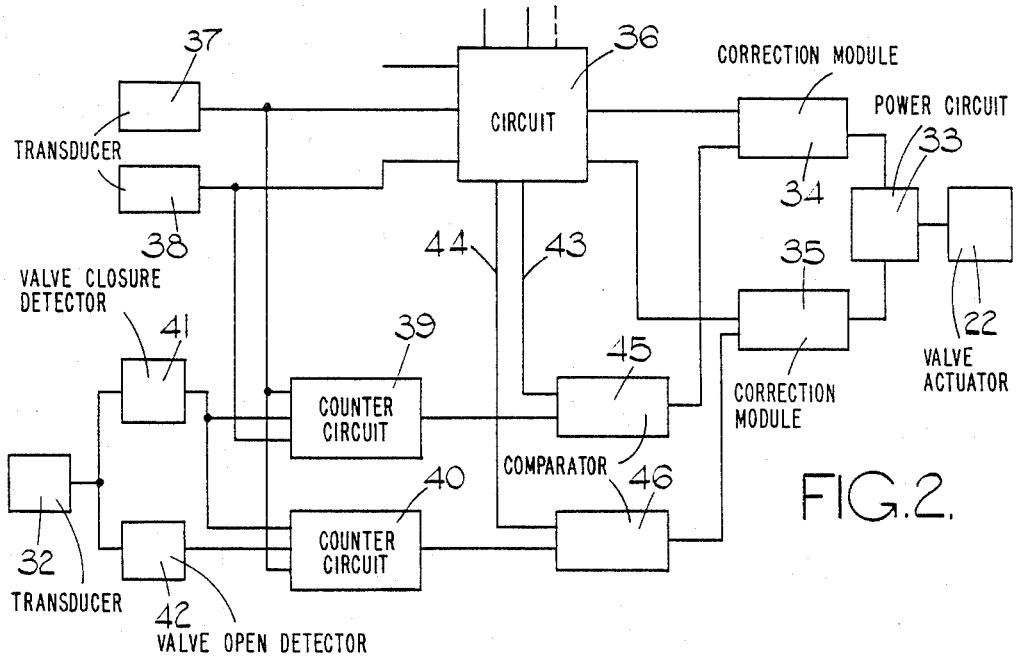
FIG. 2 is a block diagram of an electrical circuit for controlling the actuator.

Referring now to FIG. 2, the valve actuator is shown in block form at 22 and is supplied with electric current by a power circuit 33. The power circuit is controlled by two correction modules 34, 35, the module 34 providing an "ON" signal to the power circuit and the module 35 an "OFF" signal. The module 34 corrects for timing variation, that is to say, the start of delivery of fuel and the module 35 for delivery volume variations.

Also provided is a circuit 36 to which are supplied signals representative of various engine operating parameters such for example as temperature, air inlet pressure and engine speed, and also the desired operating parameter which is determined by the operator. The circuit on the basis of stored information determines the amount of fuel to be supplied to the engine at each delivery stroke of the pump and also the timing of fuel delivery to the engine. The circuit 36 is also supplied with two sets of timing signals from transducers 37, 38 which are associated with a rotary part or parts of the pump and/or associated engine. The signal provided by one of these transducers preferably the transducer 37, is used as the speed signal. The transducer 37 is arranged to produce a continuous train of pulses at a comparatively high frequency while the transducer 38 produces marker pulses, the number of marker pulses produced per revolution of the pump, being equal to the number of engine cylinders. The signals from the transducer 37 are supplied to a pair of counter circuits 39, 40 and the signal from the transducer 38 is supplied to the circuit 39 only. The circuits 39 and 40 also receive signals from a valve closure detector 41 which receives signals from the transducer 32 which is associated with the valve. The circuit 40 receives signals from a valve open detector 42, this also receiving signals from the transducer 37. The detectors 41 and 42 are arranged to take into account the fact that fuel delivery can start before the valve is fully closed and continue after the valve has started to open. In a typical example the valve might be regarded as closed when it has moved through 90% of its closing travel and open when it has moved through 10% of its opening travel.

The circuit 39 uses the signal from the transducer 38 as a start count signal, the count being the number of pulses provided by the transducer 37. The stop count signal is provided by the circuit 41 and the count value produced by the circuit 39 is therefore an indication in terms of degrees of engine rotation, of the time required for the valve to close after the marker pulse produced by the transducer 38. The circuit 40 uses the signal provided by the circuit 41 as a start count signal and that provided by the circuit 42 as a stop count signal. The count value produced by the circuit 40 is therefore an indication in terms of degrees of engine rotation of the time the valve is closed, and therefore, an indication of the amount of fuel delivered to the respective engine cylinder.

The circuit 36 produces on lines 43 and 44, the desired timing signal and the desired valve closure period or quantity signals respectively these signals are related to the marker pulses. The lines 43 and 44 are connected to the inputs of comparators 45, 46 respectively which also receive signals from the circuits 39, 40 respectively.

The circuit 36 also provides pulse signals corresponding to the marker pulses provided by transducer 38. These occur earlier than is required so that normal timing variations can be accommodated and also adjustment of the control signals to the power circuit 33 to take account of manufacturing tolerances and circuit variations and are supplied to the modules 34, 35.

Assuming for the moment the engine is operating under steady state conditions and that the timing and fuel quantity are correct. The outputs of the comparators 45 and 46 will be zero so that the pulse signals supplied by the circuit 36 to the correction modules 34, 35 will be unaffected by the modules. If there are timing and/or fuel quantity errors the modules 34, 35 on the basis of the signals supplied by the comparators 45, 46 will modify the pulse signals by an appropriate amount to achieve the desired timing and fueling the next time fuel is supplied. In this respect, it is pointed out that the correction modules include memory components which maintain a record of the actual timing and fuel quantity together with the errors to allow correction the next time fuel is delivered. If there is a change in the desired timing or fueling, the output signals provided by one or both comparators will change leading to a different delay.

It is not always desirable during the operation of the apparatus to effect complete correction of an error. For example, if a timing error of one degree occurs then it may be desirable to correct this by two half degree corrections to avoid overshoot. The determination of the amount of correction and the number of stages of correction is effected by circuits within the correction module 34.

We claim:

1. A liquid fuel pumping apparatus for supplying fuel to an internal combustion engine, the apparatus comprising a plunger reciprocable within a bore, an outlet from said bore and through which fuel can flow during inward movement of the plunger, an electromagnetically operable spill valve which controls fuel flow through a passage connected to said bore and which during inward movement of the plunger can be closed to cause fuel flow through the outlet, and means responsive to the movement of the spill valve for providing signals indicative of the state of the valve, and a control circuit to which said signals are supplied, said control circuit controlling the operation of said valve.

2. An apparatus according to claim 1 in which the means responsive to the movement of the spill valve includes a transducer having a component movable with the spill valve, and first and second detectors responsive to the signal produced by said transducer, said first and second detectors providing signals indicative of effective valve closure and opening respectively.

3. An apparatus according to claim 2 including a counter, start count and stop count inputs on said counter, means for supplying to said counter to be counted thereby, a first series of pulses the pulse rate of which depends upon the speed of rotation of the associated engine, the signal provided by said first detector being supplied to the start count input of said counter and the signal provided by said second detector being supplied to the stop count input of said counter, the count value of the counter representing the period during which the valve is closed, and a comparator in which said count value is compared with a signal representative of the desired period of valve closure.

4. An apparatus according to claim 3 including means for providing a second series of pulses which occur at predetermined engine positions, a second counter for counting said first series of pulses, start count and stop count inputs on said counter, said second series of pulses being supplied to a start count input of said second counter, and the signal from said first detector being applied to the stop count input of said second counter, the count value of said second counter representing the period required for closure of the spill valve to take place.

* * * * *